US012082669B1

(12) United States Patent
Marello

(10) Patent No.: US 12,082,669 B1
(45) Date of Patent: Sep. 10, 2024

(54) ECO-FRIENDLY LUGGAGE WRAP WITH TAMPER-EVIDENT FEATURE FOR SECURE, CONVENIENT TRAVEL

(71) Applicant: John Ray Marello, Port Orange, FL (US)

(72) Inventor: John Ray Marello, Port Orange, FL (US)

( * ) Notice: Subject to any disclaimer, the term of this patent is extended or adjusted under 35 U.S.C. 154(b) by 0 days.

(21) Appl. No.: 18/453,609

(22) Filed: Aug. 22, 2023

(51) Int. Cl.
*A45C 13/00* (2006.01)

(52) U.S. Cl.
CPC ..... *A45C 13/002* (2013.01); *A45C 2200/10* (2013.01)

(58) Field of Classification Search
CPC ..... A45C 13/002; A45C 2200/10
USPC ..... 150/154
See application file for complete search history.

(56) References Cited

U.S. PATENT DOCUMENTS

| | | | | | |
|---|---|---|---|---|---|
| D316,483 | S | * | 4/1991 | Haack | D6/610 |
| 5,083,644 | A | | 1/1992 | Collins, III | |
| D340,580 | S | * | 10/1993 | Hirschy | D6/610 |
| 5,255,765 | A | | 10/1993 | Schrecongost | |
| 5,293,975 | A | * | 3/1994 | Howorka | A45C 13/002 150/105 |
| 5,772,330 | A | * | 6/1998 | Bang | A45C 13/002 383/207 |
| 5,890,345 | A | | 4/1999 | Bauer | |
| 6,082,535 | A | * | 7/2000 | Mitchell | B65D 33/20 206/811 |
| 6,279,796 | B1 | * | 8/2001 | Trevino | A45C 13/002 224/153 |
| 7,077,251 | B1 | | 7/2006 | Gaither | |
| 7,093,699 | B2 | * | 8/2006 | Yu | A45C 13/002 150/154 |
| 7,207,154 | B2 | * | 4/2007 | Araujo | B65D 33/34 383/41 |
| 7,458,452 | B2 | | 12/2008 | Beakey | |
| D660,596 | S | | 5/2012 | Sanchez | |
| D705,541 | S | | 5/2014 | Harris | |

(Continued)

FOREIGN PATENT DOCUMENTS

| | | | |
|---|---|---|---|
| JP | H07308217 A | * | 11/1995 |
| JP | 2017192572 A | * | 10/2017 |

OTHER PUBLICATIONS

Explore Land: Travel Luggage Cover Suitcase Protector (https://www.amazon.com/dp/B0C1FP33LH/) (Year: 2017).*

(Continued)

*Primary Examiner* — Don M Anderson
*Assistant Examiner* — Justin Caudill
(74) *Attorney, Agent, or Firm* — Troutman Pepper Hamilton Sanders LLP

(57) ABSTRACT

A luggage wrap designed to envelop the luggage through a bottom opening. The luggage wrap provides a top panel connecting a front panel, a rear panel and two side panels that also define the bottom opening. A foldable side flap may extend from the bottom edge of each side panel. A wrap tongue extends from the bottom edge of the front panel to be foldable to close off the bottom opening but for four caster cutouts. Adhesive elements along an inner surface of the tongue wrap are disposed to fixedly secure to the two side flaps and the opposing rear panel in such a way that removing the adhesive connection points destroys the material of the luggage wrap to indicate tampering.

12 Claims, 3 Drawing Sheets

(56) References Cited

U.S. PATENT DOCUMENTS

| | | | | |
|---|---|---|---|---|
| 10,159,322 | B2 | 12/2018 | Yu | |
| 10,433,627 | B2 | 10/2019 | Hays et al. | |
| 11,096,459 | B2 | 8/2021 | Scott | |
| 11,470,931 | B2 | 10/2022 | Davis | |
| 2007/0193667 | A1* | 8/2007 | Beakey | A45C 13/002 190/100 |
| 2008/0088125 | A1* | 4/2008 | Montross | G09F 3/08 283/80 |
| 2009/0194210 | A1 | 8/2009 | Montross | |
| 2010/0282380 | A1 | 11/2010 | Layrana Fernandez | |
| 2011/0259692 | A1 | 10/2011 | Warncke et al. | |
| 2012/0180434 | A1* | 7/2012 | Snyder | B65D 33/34 53/469 |
| 2012/0199594 | A1 | 8/2012 | Pernarella | |
| 2014/0001191 | A1 | 1/2014 | Ream | |
| 2016/0015140 | A1 | 1/2016 | Estrella | |
| 2020/0352296 | A1 | 11/2020 | Bent | |

OTHER PUBLICATIONS

BlueCosto: Universal Clear PVC Luggage Cover Protector (https://www.amazon.com/BlueCosto-Universal-Luggage-Protector-Suitcase/dp/B0BGLGJHS9) (Year: 2022).*

MrTakeoutBags: Deliver Safe Tamper Resistant Delivery Bags (https://web.archive.org/web/20210614191937/https://www.mrtakeoutbags.com/product/deliver-safe-tamper-resistant-bags/xfscptr211510-175mil.html) (Year: 2021).*

* cited by examiner

ECO-FRIENDLY LUGGAGE WRAP WITH TAMPER-EVIDENT FEATURE FOR SECURE, CONVENIENT TRAVEL

BACKGROUND OF THE INVENTION

The present invention relates to luggage security and, more particularly, to a single-use eco-friendly luggage wrap with tamper-evident feature for secure, convenient travel.

At the time of this writing, tourism has bounced back with a vengeance from the COVID period. Thus, more than ever, travelers are facing the challenges related to unsecured luggage; specifically, the issues of time spent waiting in airports for luggage wrapping services and the environmental damage caused by excessive plastic waste.

Current systems in the field of luggage security, such as airport wrapping machines, suffer from inefficiencies and limitations. They are time-consuming, occasionally understaffed, and often costly for travelers. Moreover, these systems lack tamper-evident features, leaving luggage more vulnerable to tampering.

These devices and systems are less effective because they can be highly inconvenient for consumers, especially those in a hurry or with children, as they require waiting in line at the airport. Moreover, they generate a significant amount of environmentally harmful plastic waste. Additionally, the costs for these services can be burdensome for travelers, and they lack the tamper-evident feature that enhances luggage security.

As can be seen, there is a need for an eco-friendly luggage wrap with tamper-evident feature for secure, convenient travel.

SUMMARY OF THE INVENTION

The present invention provides a solution that does not require consumers to rely on external wrapping companies, which can be both time-consuming and costly.

The present invention significantly streamlines the luggage wrapping process by allowing consumers to secure their bags quickly and easily without waiting in line at the airport. It also utilizes a more sustainable approach that reduces plastic waste, offers cost savings, and includes a tamper-evident feature for enhanced security.

The present invention addresses the challenges of unsecured luggage by enabling consumers to wrap their luggage swiftly and securely in just a few simple steps, saving valuable time. Additionally, it incorporates a sealing process that indicates if the bag has been tampered with, providing an extra layer of security for the contents.

The present invention significantly improves upon existing solutions by requiring just a single piece of material and enabling any consumer to easily wrap and secure their luggage. Additionally, it incorporates tamper-evident features, providing an enhanced level of security for travelers.

In one aspect of the present invention, a luggage wrap includes a top panel, a front panel, a rear panel, and two side panels dimensioned and shaped to define a compartment for enveloping a luggage, wherein the compartment communicates to an external environment by way of a bottom opening defined by bottom edges of the front panel, the rear panel, and the two side panels; a side flap extending from each side panel by way of a pivotable connection; an hourglass shaped wrap tongue foldably joined to the bottom edge of the front panel to close off the bottom opening but for each corner of the bottom opening; and a plurality of adhesive elements disposed along an inner surface of the wrap tongue to form a sealed condition with each of the two side flaps folded over the bottom opening, wherein a material of said side flaps is configured to be tamper-evident prior to at least one adhesive element being moved from the sealed condition to an unsealed condition.

In another aspect of the present invention, the luggage wrap further includes, wherein tamper-evident is a visible failure of said material or is a visible failure of the pivotable connection, wherein the wrap tongue in the sealed condition defines corner voids dimensioned and shaped so that a caster element of the luggage enveloped in the compartment protrudes into the external environment, wherein the top panel provides one or more slits for receiving a handle of the luggage enveloped in the compartment, wherein the material of said panels and side flaps is transparent or translucent; further including gussets along each of the two side panels enabling the luggage wrap to move to a folded condition when not enveloping the luggage, and wherein the sealed condition further comprises one of the plurality of adhesive elements engaging a bottom edge or adjacent thereto of the rear panel.

These and other features, aspects and advantages of the present invention will become better understood with reference to the following drawings, description and claims.

DETAILED DESCRIPTION OF THE INVENTION

The following detailed description is of the best currently contemplated modes of carrying out exemplary embodiments of the invention. The description is not to be taken in a limiting sense but is made merely for the purpose of illustrating the general principles of the invention, since the scope of the invention is best defined by the appended claims.

Broadly, an embodiment of the present invention provides a luggage wrap designed to envelop the luggage through a bottom opening. The luggage wrap provides a top panel connecting a front panel, a rear panel and two side panels that also define the bottom opening. A foldable side flap may extend from the bottom edge of each side panel. A wrap tongue extends from the bottom edge of the front panel to be foldable to close off the bottom opening but for four caster cutouts.

Adhesive elements along an inner surface of the tongue wrap are disposed to fixedly secure to the two side flaps and the opposing rear panel in such a way that removing the adhesive connection points destroys the material of the luggage wrap to indicate tampering.

Figure 1:
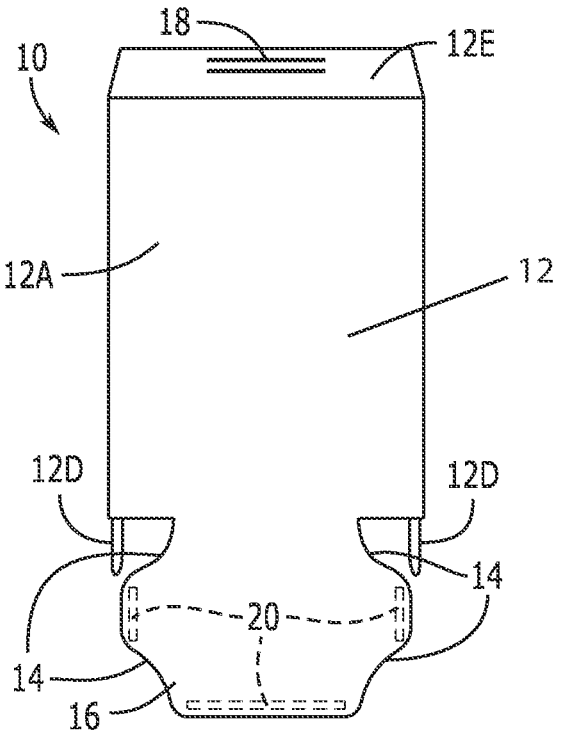
FIG. 1 is a front elevation view of an exemplary embodiment of the present invention, shown in an open condition.
Figure 2:
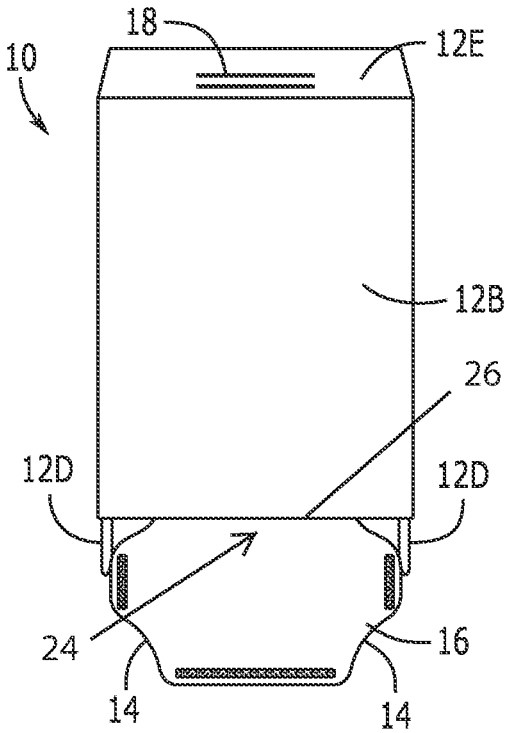
FIG. 2 is a rear elevation view of an exemplary embodiment of the present invention, shown in the open condition.
Figure 3:
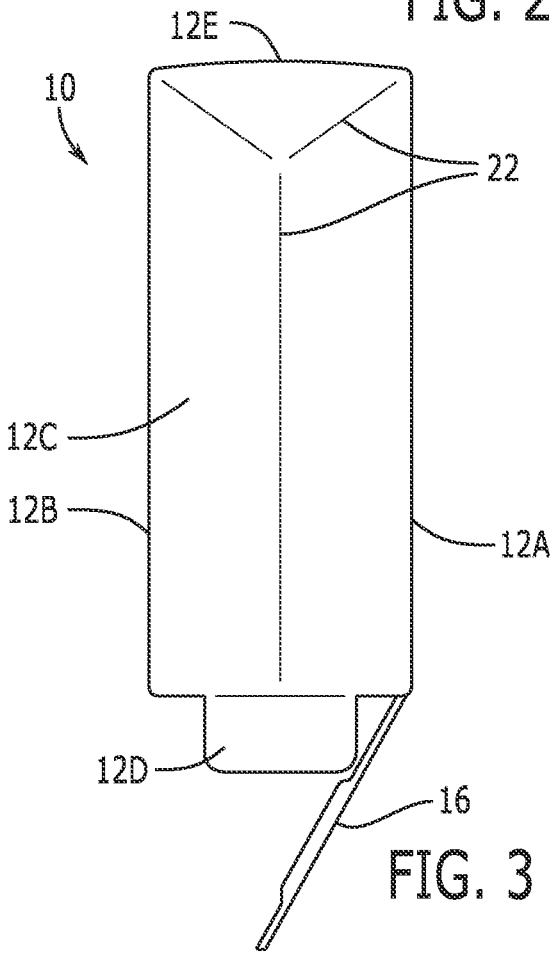
FIG. 3 is a side elevation view of an exemplary embodiment of the present invention, shown in the open condition.
Figure 4:
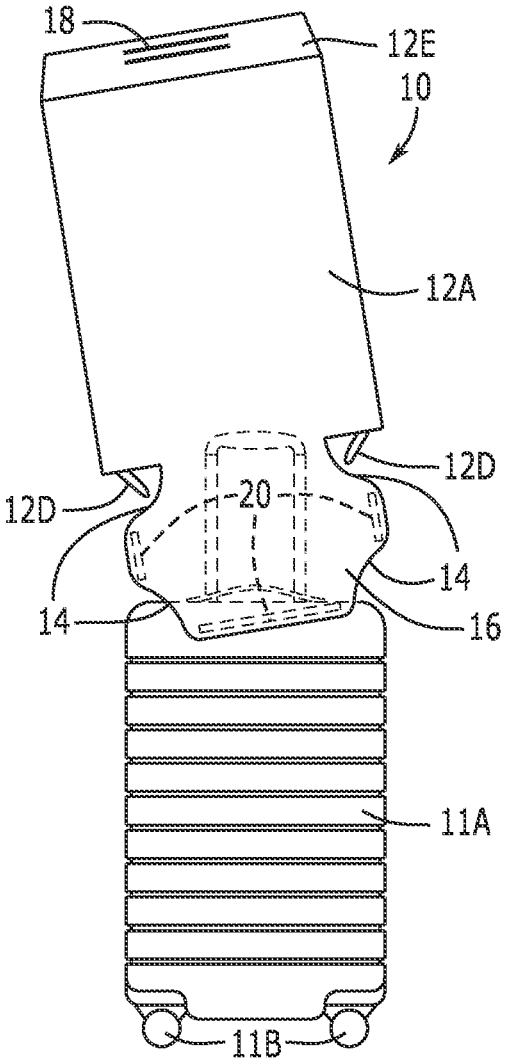
FIG. 4 is a side elevation view of an exemplary embodiment of the present invention, illustrating a wrap 10 in an initial phase of enveloping a piece of luggage 11A.
Figure 5:
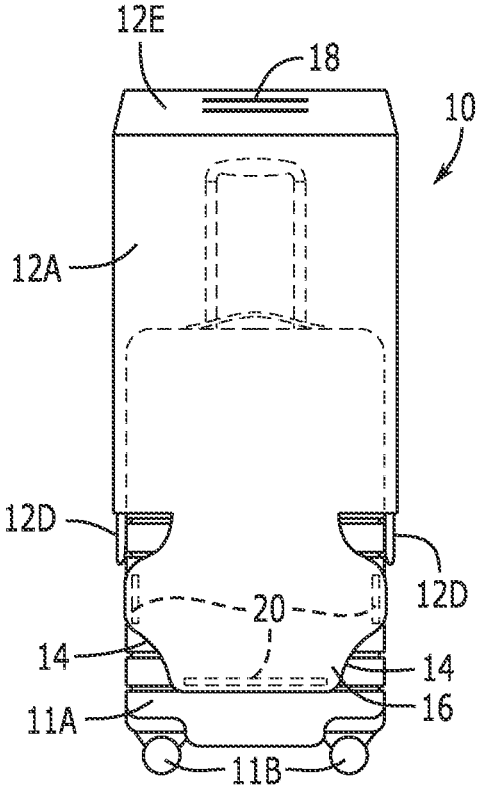
FIG. 5 is a side elevation view of an exemplary embodiment of the present invention, illustrating the wrap 10 in an intermediate phase of enveloping the piece of luggage 11A.
Figure 6:
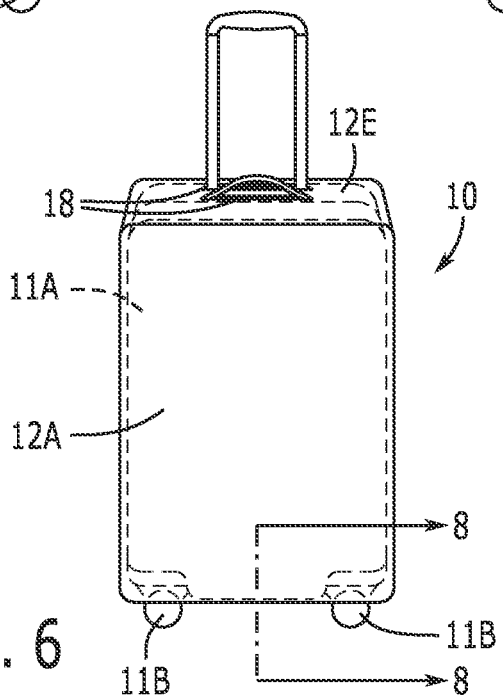
FIG. 6 is a front elevation view of an exemplary embodiment of the present invention, illustrating the wrap 10 in a closed condition after enveloping the piece of luggage 11A.
Figure 7:
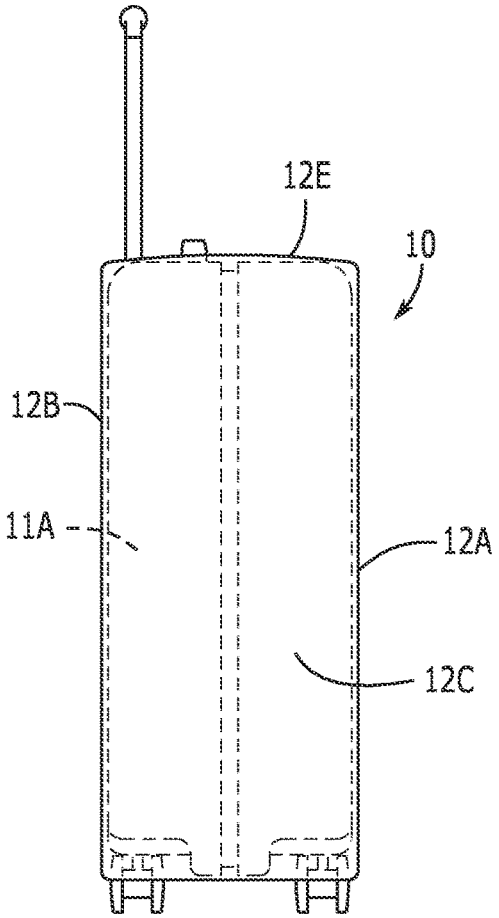
FIG. 7 is a side elevation view of an exemplary embodiment of the present invention, illustrating the closed condition.
Figure 8:
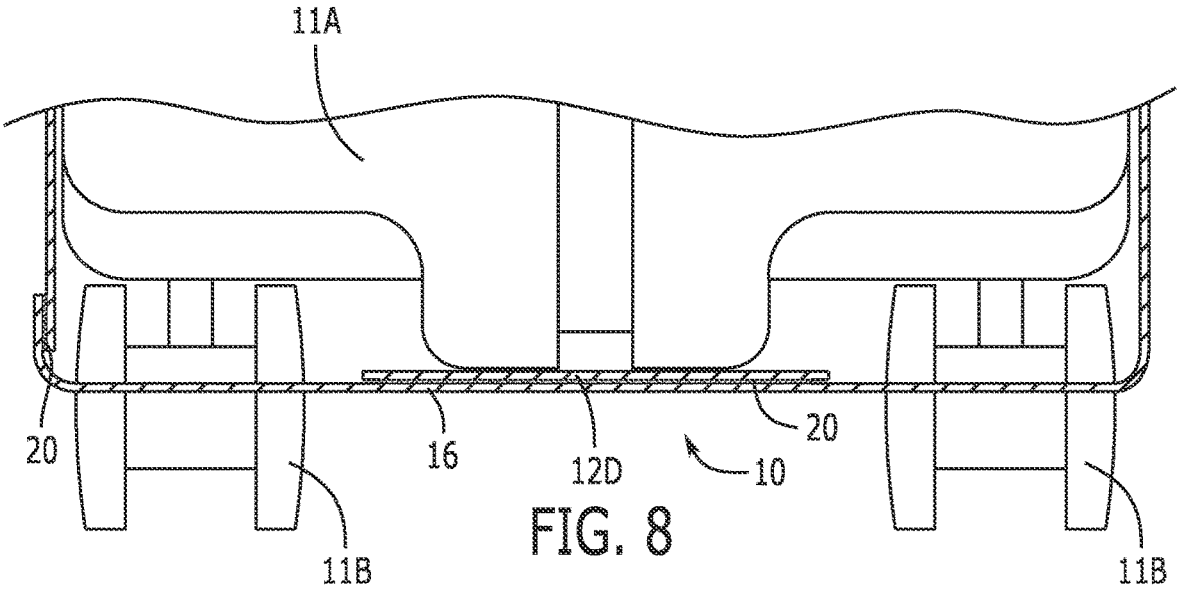
FIG. 8 is an enlarged detailed cross-sectional view of an exemplary embodiment of the present invention, taken along line 8-8 in FIG. 6.

Referring to FIGS. 1-8, the present invention may include an eco-friendly luggage wrap 10 with tamper-evident feature for secure, convenient travel. The luggage wrap 10 may be dimensioned and shaped to envelop or encompass a piece of luggage 11A. The luggage wrap 10 may have a body 12 defining a compartment for slidably receiving the luggage 11A. The boxy body 12 may comprise a front panel 12A, a rear panel 12B, two side panels 12C and top panel 12E having a periphery that is joined to the top edges of the front, rear, and two side panels 12A, 12B, 12C. At the other end of the body, the front, rear, and two side panels 12A, 12B, 12C define bottom opening 24 dimensioned for receiving the luggage 11A. The front, rear, and two side panels 12A, 12B, 12C may be durable, flexible material that enable the functionality disclosure herein, including various plasticized materials. Said material may be transparent, semi-transparent, translucent or the like.

The top panel 12E has one or more handle slits 18 for enabling a handle of an enveloped luggage to protrude therethrough. Each side panel 12C may provide gusset fold lines 22 to enable the body 12 to fold between a flat condition and an operative condition. A bottom edge of each side panel 12C may provide a side flap 12D that extends beyond said bottom edge away from the top panel 12E. Each side flap 12D may be pivotably connected (along a fold line) to said bottom edge so that the side flap 12D is selectively movable between an extended position (parallel with the side panel 12C) and a folded position. Note, fold lines may be living hinges or other pivotable connections.

A wrap tongue 16 extends from a bottom edge 26 of the rear or front panel 12A or 12B. The wrap tongue 16 is pivotably connected (along a fold line) to said bottom edge 26 so that the wrap tongue 16 is selectively movable between an extended position (parallel with the front or rear panel 12*a* or 12B) and a folded position where it can engage the side flaps 12D in their folded position. Adhesive elements 20 may be provided along an inner surface of the wrap tongue 16 so that when the wrap tongue 12 foldably engages the side flaps 12D the adhesive elements 20 fixedly secure thereto. The adhesive properties of the adhesive elements are such that attempts to separate adhered portions of the luggage wrap 10 would result in destroying the luggage wrap 10. An adhesive element 20 may be disposed along a distal end of the inner surface of the wrap tongue 16 for engaging a bottom (outer) edge of the opposing front or rear panel 12A or 12B. The adhesive element may be a strip of adhesive material with a removable, peelable cover. The wrap tongue 16 has an hourglass shape so that at each of the four corners of the opening 24 of the body 12 a caster void 14 is present for enabling casters elements 11B of the luggage 11A to protrude through said caster voids 14. It should be understood that casters elements 11B include wheels as well as wheel stands (wheel stands being protrusions that extend approximately the same distance from the bottom surface of the luggage 11A as a wheel, yet do not rotate as they are essentially 'feet' that enable the luggage to remain stationary in a upright position, whereby a pair of wheel stands are usually spaced apart a pair of wheels so that a user of the luggage 11A need only tilt the luggage 11A onto the pair of wheels to roll the luggage 11A).

When enveloped around luggage 11A the adhesive elements 20 are critical. The adhesive element 20 is what holds the luggage wrap 10 together. It also secures luggage 11A so if someone wanted to break into luggage 11A they would have to destroy the luggage wrap 10. The only way to remove the luggage wrap 10 is to cut through it therefore it would not be able to be reused.

Material selection includes using a durable, flexible, and environmentally friendly material for the outer wrap that tears when attempting to remove two portions joined by the adhesive element 20. Yet material should be strong enough to withstand the rigors of travel while having these tamper-evident properties.

The size and shape of the body 12 may vary to accommodate various sizes of luggage 11A. The top panel 12A may create the handle slits 18 through a die-cut area to allow the luggage handle to protrude for convenient handling.

All four elements of the invention are essential for its functionality and effectiveness. The choice of material is crucial for durability and environmental considerations, while the adhesive ensures a secure and snug fit. The present invention may use similar tamper evident material and adhesive that is used in postal service plastic shipping packages. The adhesive used to seal the luggage wrap 10 is selected to be extremely strong: once the bag is sealed, trying to pull it apart would not break the adhesive bond. The bag material, while still durable enough for its intended purpose, is designed to be the "weakest link" in the security chain. This means that, when subjected to force, the bag material would tear before the adhesive bond breaks. The design of the wrap is necessary for accommodating various luggage sizes and incorporating the tamper-evident feature.

The adhesive elements 20 are configured to develop an excellent bond (a "sealed condition") to smooth and porous papers, polyethylene, polyester, and many smooth plasticized surfaces. The bonding can be accomplished by any suitable process such as the application of pressure. Adhesive elements 20 provide a sufficiently strong bond between the side flap 12D and an opposing panel of the body to act as the main seal between these elements; particularly, the bond between the adhesive element 20 and a side flap 12D is greater than the bond/joint between the side flap 12D and its respective side panel 12C (along the bottom edge 26, fold line, pivotable connection). Accordingly, if after a sealed condition is formed, an attempt to separate the bond between the wrap tongue 16 and a side flap 12D or body panel would not result in the wrap tongue 16 peeling off of the side flap 12D or body panel, but rather would result in the visible failure of the joint between the side flap 12D and side panel 12C or visible failure of the material of the panel or the side flap 12D. Thereby enabling a tamper-evident connection.

A method of using the present invention may include the following: the adhesive strips may be put in different locations on the material. Remove the luggage wrap from its packaging and unfold it. Position the wrap above the luggage, aligning the die-cut area at the top with the luggage handle. Slide the wrap over the luggage, allowing the handle to protrude through the die-cut area slit for easy handling. Then assess the snugness of the wrap around the luggage. Hold the left side of the wrap and peel off the material covering adhesive material. Pull adhesive elements firmly and attach it to the corresponding section of the wrap, ensuring a snug fit around the luggage. Locate adhesive elements on the reverse side of the wrap's tongue, and peel off the protective material. Pull adhesive elements, by way of the wrap tongue, and attach it to the designated section of the wrap to secure the tongue and complete the wrapping process. Inspect the wrap to ensure it is tightly secured around the luggage, with the tamper-evident feature activated.

As used in this application, the term "about" or "approximately" refers to a range of values within plus or minus 10% of the specified number. And the term "substantially" refers to up to 80% or more of an entirety. Recitation of ranges of values herein are not intended to be limiting, referring instead individually to any and all values falling within the range, unless otherwise indicated, and each separate value within such a range is incorporated into the specification as if it were individually recited herein.

For purposes of this disclosure, the term "aligned" means parallel, substantially parallel, or forming an angle of less than 35.0 degrees. For purposes of this disclosure, the term "transverse" means perpendicular, substantially perpendicular, or forming an angle between 55.0 and 125.0 degrees. Also, for purposes of this disclosure, the term "length" means the longest dimension of an object. Also, for purposes of this disclosure, the term "width" means the dimension of an object from side to side. For the purposes of this disclosure, the term "above" generally means superjacent, substantially superjacent, or higher than another object although not directly overlying the object. Further, for purposes of this disclosure, the term "mechanical communication" generally refers to components being in direct physical contact with each other or being in indirect physical contact with each other where movement of one component affects the position of the other.

The use of any and all examples, or exemplary language ("e.g.," "such as," or the like) provided herein, is intended merely to better illuminate the embodiments and does not pose a limitation on the scope of the embodiments or the claims. No language in the specification should be construed as indicating any unclaimed element as essential to the practice of the disclosed embodiments.

In the following description, it is understood that terms such as "first," "second," "top," "bottom," "up," "down," and the like, are words of convenience and are not to be construed as limiting terms unless specifically stated to the contrary.

It should be understood, of course, that the foregoing relates to exemplary embodiments of the invention and that modifications may be made without departing from the spirit and scope of the invention as set forth in the following claims.

What is claimed is:

1. A luggage wrap comprising:

a top panel, a front panel, a rear panel, and two side panels dimensioned and shaped to define a compartment for enveloping luggage, wherein the compartment communicates to an external environment by way of a bottom opening defined by bottom edges of the front panel, the rear panel, and the two side panels;

a side flap extending from each of the side panels by way of a pivotable connection;

an hourglass shaped wrap tongue foldably joined to the bottom edge of the front panel to close off the bottom opening but for each corner of the bottom opening; and a plurality of adhesive materials disposed along an inner surface of the wrap tongue and configured to form a sealed condition with each of the two side flaps folded over the bottom opening, wherein a tear resistance of the wrap tongue in the sealed condition with each of the two side flaps is greater than a tear resistance of another portion, wherein the another portion comprises the pivotable connection between one of the side flaps and one of the side panels.

2. The luggage wrap of claim 1, wherein the wrap tongue in the sealed condition defines corner voids dimensioned and shaped so that a caster of the luggage enveloped in the compartment protrudes into the external environment.

3. The luggage wrap of claim 1, wherein the top panel provides one or more slits for receiving a handle of the luggage enveloped in the compartment.

4. The luggage wrap of claim 1, wherein the material of the panels and side flaps is transparent or translucent.

5. The luggage wrap of claim 1, further comprises gussets along each of the two side panels enabling the luggage wrap to move to a folded condition when not enveloping the luggage.

6. The luggage wrap of claim 1, wherein the sealed condition further comprises one of the plurality of adhesive materials configured to engage a bottom edge or adjacent thereto of the rear panel.

7. A method for making a luggage wrap, the method comprising:

defining with a top panel, a front panel, a rear panel, and two side panels a compartment dimensioned and shaped to envelope luggage, wherein the compartment communicates to an external environment by way of a bottom opening defined by bottom edges of the front panel, the rear panel, and the two side panels;

providing a side flap that extends from each of the side panels by way of a pivotable connection;

providing an hourglass shaped wrap tongue foldably joined to the bottom edge of the front panel to close off the bottom opening but for each corner of the bottom opening; and disposing a plurality of adhesive materials along an inner surface of the wrap tongue which are configured to form a sealed condition with each of the two side flaps folded over the bottom opening, wherein a tear resistance of the wrap tongue in the sealed condition with each of the two side flaps is greater than a tear resistance of another portion, wherein the another portion comprises the pivotable connection between one of the side flaps and one of the side panels.

8. The method of claim 7, wherein the wrap tongue in the sealed condition defines corner voids dimensioned and shaped so that a caster of the luggage enveloped in the compartment protrudes into the external environment.

9. The method of claim 7, further comprising forming one or more slits in the top panel dimensioned and shaped to receive a handle of the luggage enveloped in the compartment.

10. The method of claim 7, wherein the material of the panels and side flaps is transparent or translucent.

11. The method of claim 7, further comprises providing gussets along each of the two side panels enabling the luggage wrap to move to a folded condition when not enveloping the luggage.

12. The new claim 7, wherein one of the plurality of adhesive materials in the sealed positioned is configured to engage a bottom edge or adjacent thereto of the rear panel.

* * * * *